US011696077B2

(12) United States Patent
Song et al.

(10) Patent No.: US 11,696,077 B2
(45) Date of Patent: Jul. 4, 2023

(54) SPEAKER DEVICE

(71) Applicant: AAC Microtech (Changzhou) Co., Ltd., Changzhou (CN)

(72) Inventors: Wei Song, Shenzhen (CN); Xin Jin, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 9 days.

(21) Appl. No.: 17/522,928

(22) Filed: Nov. 10, 2021

(65) Prior Publication Data

US 2022/0150638 A1 May 12, 2022

(30) Foreign Application Priority Data

Nov. 12, 2020 (CN) ..... 202022621598.X

(51) Int. Cl.
*H04R 9/02* (2006.01)
*H04R 7/20* (2006.01)

(52) U.S. Cl.
CPC ..... *H04R 9/025* (2013.01); *H04R 7/20* (2013.01)

(58) Field of Classification Search
CPC . H04R 9/025; H04R 7/20; H04R 1/06; H04R 2400/11; H04R 7/18; H04R 9/04; H04R 9/043
See application file for complete search history.

(56) References Cited

U.S. PATENT DOCUMENTS

| | | | | |
|---|---|---|---|---|
| 11,026,025 | B2 * | 6/2021 | Xiao | H04R 7/127 |
| 11,240,605 | B2 * | 2/2022 | Song | H04R 9/025 |
| 11,570,534 | B2 * | 1/2023 | Song | H04R 1/026 |

FOREIGN PATENT DOCUMENTS

| | | | | |
|---|---|---|---|---|
| CN | 109379681 A | * | 2/2019 | H04R 9/025 |
| CN | 109889964 A | * | 6/2019 | F04B 35/04 |
| CN | 110121134 A | * | 8/2019 | |
| CN | 209201338 U | * | 8/2019 | |
| CN | 209390315 U | * | 9/2019 | H04R 7/12 |
| CN | 209390343 U | * | 9/2019 | H04R 7/127 |
| CN | 209526874 U | * | 10/2019 | H04R 1/06 |

* cited by examiner

*Primary Examiner* — Angelica M McKinney
(74) *Attorney, Agent, or Firm* — W&G Law Group

(57) ABSTRACT

The present disclosure provides speaker device. The speaker device includes frame, vibration unit and magnetic circuit unit, where vibration unit includes diaphragm, voice coil and holder; holder includes holder body and first connecting portion; voice coil includes pair of first sides and pair of second sides; first side is provided with elastic support member fixed to frame and fixed to first connecting portion; elastic support member and first side enclose an accommodating space; magnetic circuit unit includes main magnetic body and an auxiliary magnetic body; auxiliary magnetic body includes first magnetic portion that is respectively spaced apart from first side and located in accommodating space; elastic support member include an auxiliary diaphragm; auxiliary diaphragm is provided with an avoiding groove. The present disclosure can increase volume of magnetic circuit unit to increase BL value, and can effectively reduce weight of vibration unit to improve sensitivity.

8 Claims, 9 Drawing Sheets

SPEAKER DEVICE

TECHNICAL FIELD

The present disclosure relates to the field of electro-acoustic conversion, in particular to a speaker device.

BACKGROUND

In order to adapt to the miniaturization and multi-functionalization of various audio equipment and information communication equipment, the speaker devices used in such equipment are required to be miniaturized so as to closely fit with surrounding units. In particular, with the development of lighter and thinner mobile phones, the quality requirements for the speaker devices are getting higher.

In the related art, a speaker device includes a frame and a vibration unit and a magnetic circuit unit respectively held to the frame. The vibration unit includes a diaphragm held to the frame, a voice coil driving the diaphragm to vibrate and produce sound and a holder. The holder includes a main body portion fixed to the diaphragm and a first connecting portion extending from the main body portion in a direction away from the diaphragm. The voice coil includes a pair of first sides and a pair of second sides connected between the first sides. Each of the pair of the first sides is provided with an elastic support member. One end of the elastic support member is fixed to the frame, and another end of the elastic support member is fixed to the first connecting portion. The elastic support member and the first side enclose an accommodating space. The magnetic circuit unit includes a main magnetic body and auxiliary magnetic bodies surrounding the main magnetic body and a magnetic gap is formed between the auxiliary magnetic body and the main magnetic body. There are four auxiliary magnetic bodies, namely first auxiliary magnetic bodies that are spaced apart from the first sides and located in the accommodating spaces and second auxiliary magnetic bodies that are spaced apart from the second sides. However, such a magnetic circuit unit cannot make full use of the internal space of the speaker device.

Therefore, it is necessary to provide a speaker device to solve the above problem.

SUMMARY

An objective of the present disclosure is to provide a speaker device. The speaker device can increase the volume of a magnetic circuit unit to increase a BL value, i.e. a force factor of the speaker device, and can effectively reduce the weight of a vibration unit to improve sensitivity.

The speaker device provided by the present disclosure includes a frame and a vibration unit and a magnetic circuit unit respectively held to the frame, where the vibration unit includes a diaphragm held to the frame, a voice coil driving the diaphragm to vibrate and produce sound and a holder; the holder includes a holder body fixed to the diaphragm and a first connecting portion extending from the holder body in a direction away from the diaphragm; the voice coil includes a pair of first sides and a pair of second sides connected between the first sides; each of the pair of the first sides is provided with an elastic support member; one end of each of the elastic support members is fixed to the frame, and another end of the elastic support member is fixed to the first connecting portion; the elastic support member and the first side enclose an accommodating space; the magnetic circuit unit includes a main magnetic body and an auxiliary magnetic body surrounding the main magnetic body, and a magnetic gap is formed between the auxiliary magnetic body and the main magnetic body; the auxiliary magnetic body includes a first magnetic portion that is spaced apart from the first sides and located in the accommodating space and a second magnetic portion that is spaced apart from the second sides; the elastic support member include an auxiliary diaphragm; the auxiliary diaphragm is provided with an avoiding groove; the first magnetic portion includes a main body portion and an extension portion extending from a side of the main body portion away from the first side into the avoiding groove; and the first connecting portion is provided with a notch for avoiding extension portions.

As an improvement, the first magnetic portion and the second magnetic portion may be formed into one piece.

As an improvement, each of the first magnetic portion and the second magnetic portion may is provided with two permanent magnets that are spaced from each other.

As an improvement, the auxiliary diaphragm may include a first fixing portion fixed to the frame, a second fixing portion connected to the first connecting portion, and a suspension portion connecting the first fixing portion and the second fixing portion; and the avoiding groove extends from a side of the second fixing portion away from the first fixing portion to the suspension portion.

As an improvement, the elastic support member further include a flexible printed circuit board; the flexible printed circuit board may include a holding portion connected to the first fixing portion, a coupling portion connected to the second fixing portion and an elastic arm connecting the holding portion and the coupling portion; an opening of the suspension portion faces the flexible printed circuit board; and an orthographic projection of the elastic arm on the auxiliary diaphragm may be located within the suspension portion.

As an improvement, the flexible printed circuit board may be located between the auxiliary diaphragm and the diaphragm.

As an improvement, the holder may further include a second connecting portion extending from the holder body in the direction away from the diaphragm; and the voice coil may be connected to the second connecting portion.

As an improvement, the second connecting portion is provided with a plurality of gaps; the plurality of gaps divide the second connecting portion into the plurality of isolation portions that may be spaced apart from each other; and the voice coil may be fixed to the plurality of isolation portions.

As an improvement, the magnetic circuit unit may further include an upper splint covering the auxiliary magnetic body and fixed to the frame and a pole plate covering the main magnetic body; and the upper splint may be provided with a through hole, and the pole plate may be located in the through hole.

Compared with the related art, in the present disclosure, through the avoiding grooves provided on the auxiliary diaphragms and the notches provided on the first connecting portions, the first magnetic portions extend into the avoiding grooves. In this way, the present disclosure can increase the volume of the magnetic circuit unit so as to increase the BL value, and can also reduce the swing of the vibration unit through the support of the elastic support members. Meanwhile, by removing the material in the notch area of the holder, the present disclosure can effectively reduce the weight of the vibration unit to improve the sensitivity of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

Figure 1:
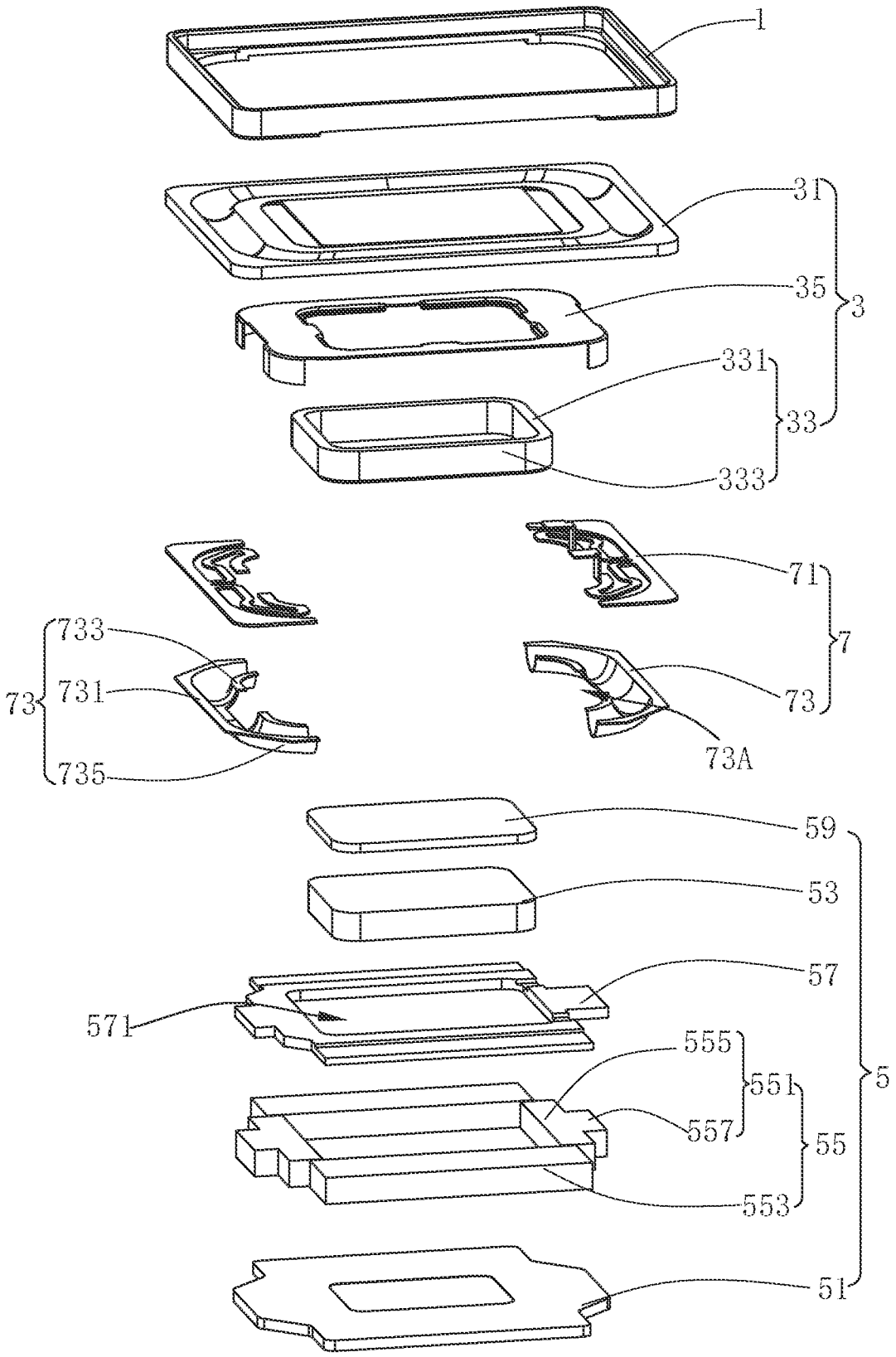
FIG. 1 is a three-dimensional exploded view illustrating a structure of a speaker device according to a preferred embodiment of the present disclosure.
Figure 2:
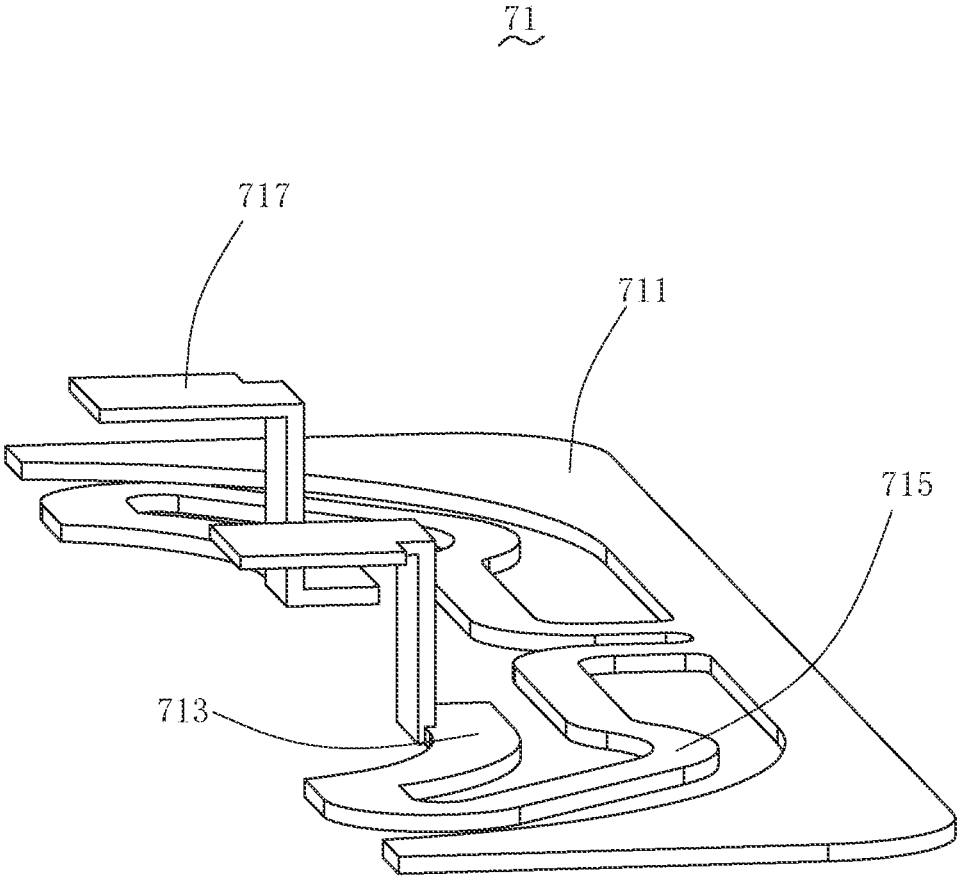
FIG. 2 is a view illustrating a structure of a flexible printed circuit board of the speaker device shown in FIG. 1.
Figure 3:
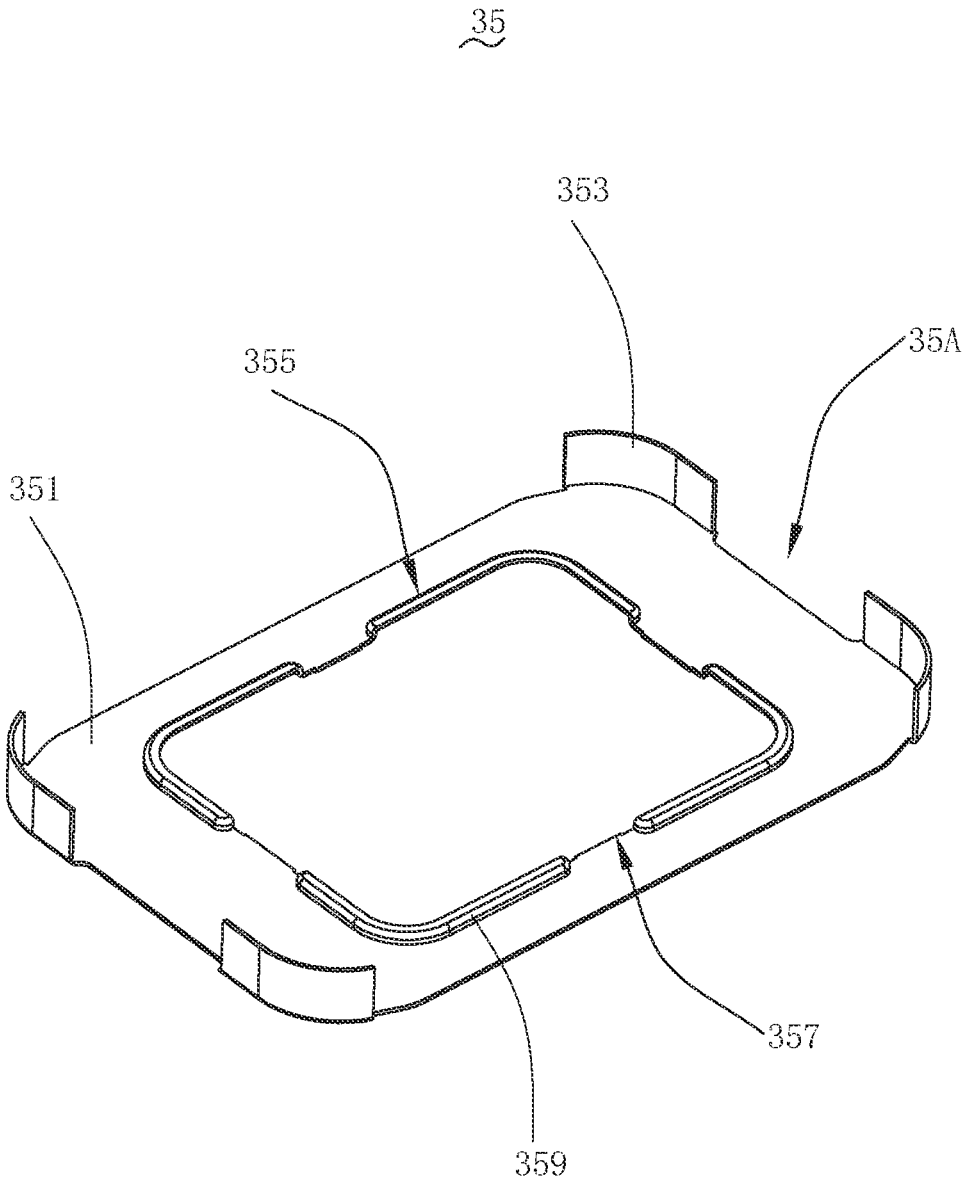
FIG. 3 is a view illustrating a structure of a holder of the speaker device shown in FIG. 1.
Figure 4:
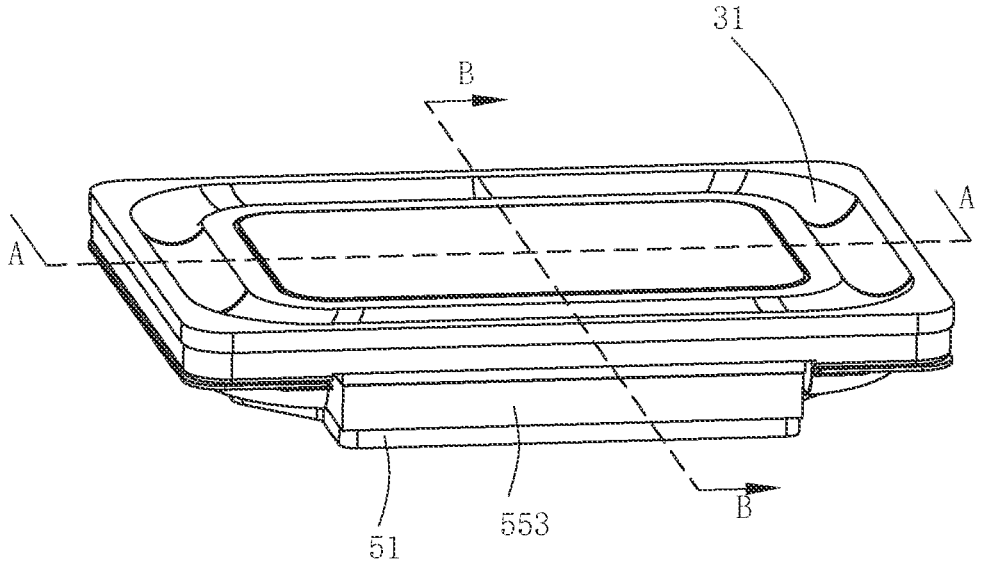
FIG. 4 is a three-dimensional view of the speaker device shown in FIG. 1, after assembly.

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those of ordinary skill in the art based on the embodiments in the present disclosure without creative efforts should fall within the protection scope of the present disclosure.

As shown in FIGS. 1 to 9, a speaker device includes a frame 1 and a vibration unit 3 and a magnetic circuit unit 5 respectively fixed to the frame 1. The magnetic circuit unit 5 drives the vibration unit 3 to vibrate and produce sound.

The vibration unit 3 includes a diaphragm 31 fixed to the frame 1, a voice coil 33 driving the diaphragm 31 to vibrate and produce sound and a holder 35. The holder 35 includes a holder body 351 fixed to the diaphragm 31 and a first connecting portion 353 extending from the holder body 351 in a direction away from the diaphragm 31. The voice coil 33 is connected to an external circuit. After the voice coil 33 is energized, the voice coil 33 vibrates under the action of a magnetic field of the magnetic circuit unit 5. Meanwhile, the voice coil 33 drives the diaphragm 31 to vibrate and produce sound, and the diaphragm 31 drives the holder 35 to vibrate together.

Figure 7:
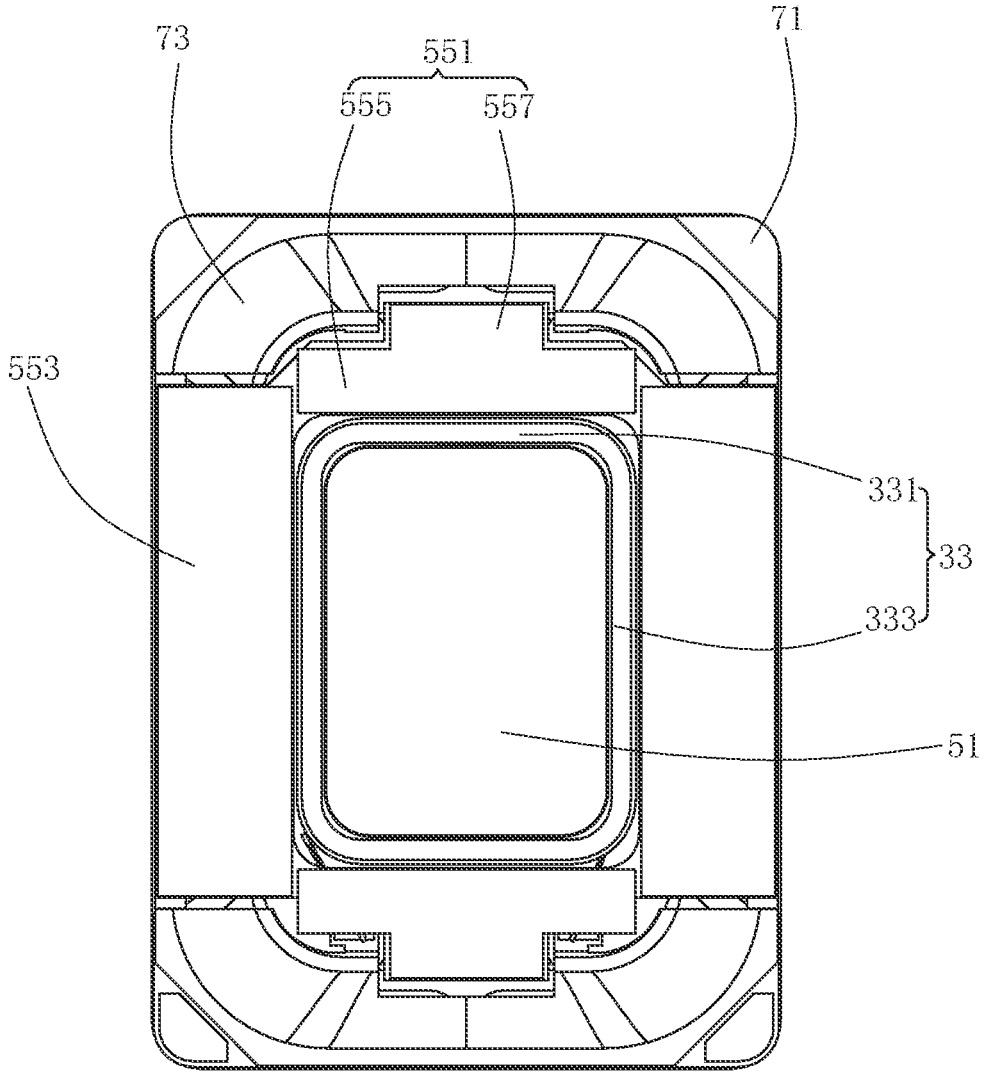
FIG. 7 is a view illustrating a structure of the speaker device (with a yoke removed) shown in FIG. 4 from another angle.
Figure 8:
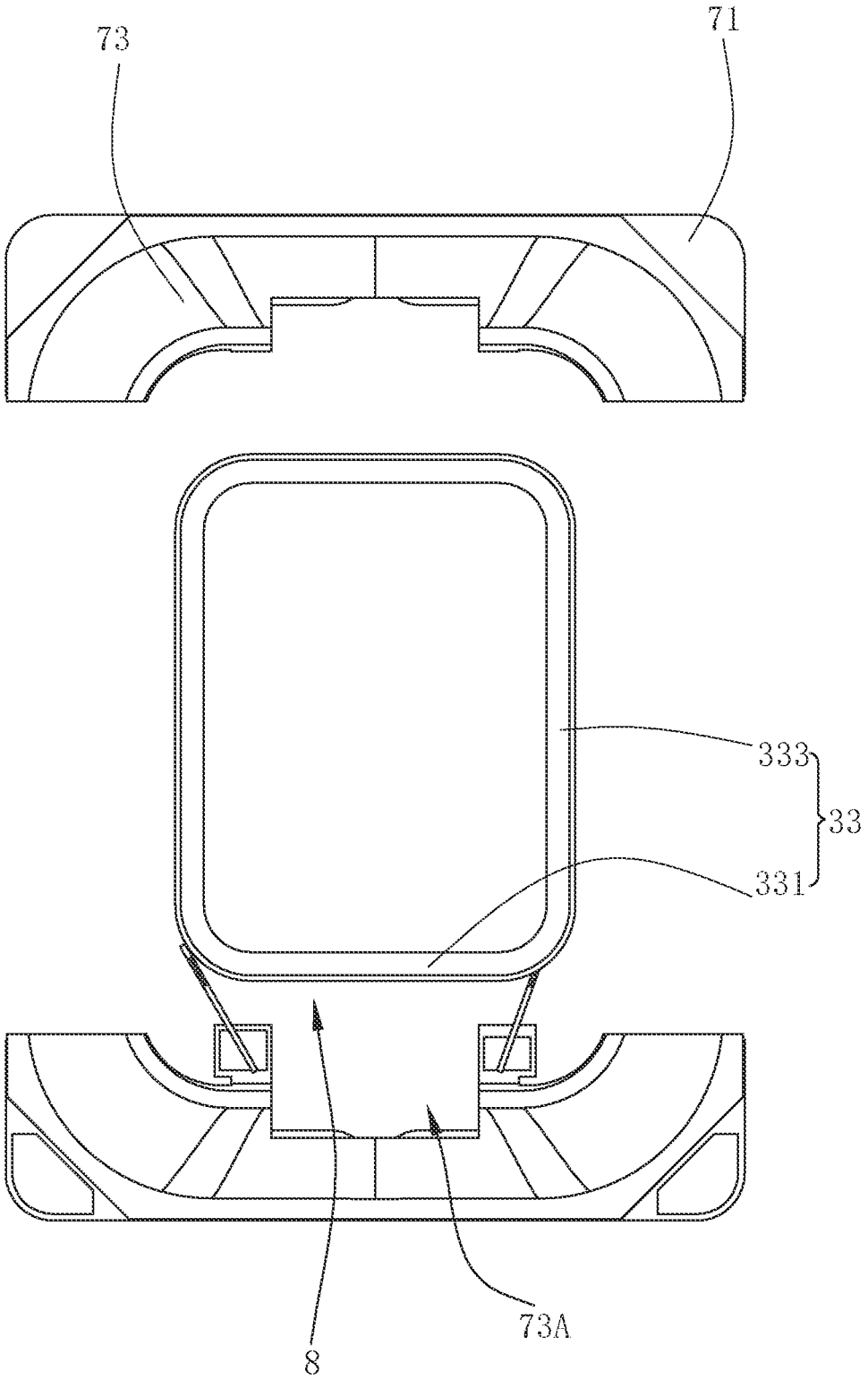
FIG. 8 is a view illustrating a structure of the elastic support member and a voice coil of the speaker device shown in FIG. 1, after assembly.
Figure 9:
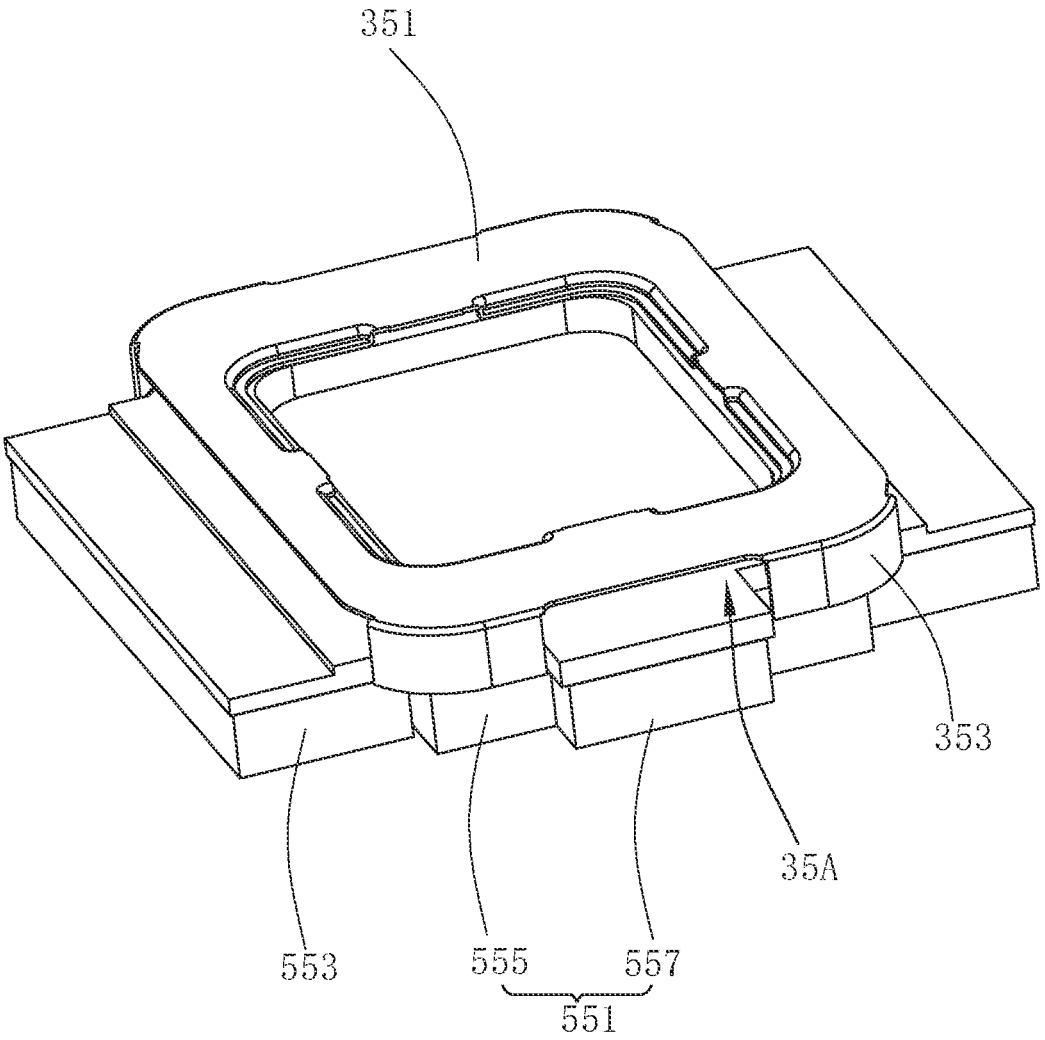
FIG. 9 is a view illustrating a structure of an upper splint, an auxiliary magnetic body and the holder of the speaker device shown in FIG. 1, after assembly.

The voice coil 33 includes a pair of first sides 331 and a pair of second sides 333 connected between the first sides 331. As shown in FIGS. 1 and 7, the first side 331 is located in a long axis direction of the speaker device, and the second side 333 is located in a short axis direction of the speaker device.

The first side 331 is provided with an elastic support member 7. One end of the elastic support member 7 is fixed to the frame 1, and another end of the elastic support member is fixed to a corresponding first connecting portion 353. The elastic support member 7 and the first side 331 enclose an accommodating space 8. When the voice coil 33 vibrates, it also drives the elastic support member 7 to vibrate together.

In this embodiment, the holder 35 further includes a second connecting portion 355 extending from the holder body 351 in the direction away from the diaphragm 31. The voice coil 33 is connected to the second connecting portion 355.

In this embodiment, the second connecting portion 355 is provided with a plurality of gaps 357. The plurality of gaps 357 divide the second connecting portion 355 into a plurality of isolation portions 359 that are spaced apart from each other. The voice coil 33 is fixed to the isolation portions 359.

It is understandable that, in other implementations, the holder may not include the second connecting portion. Correspondingly, the voice coil is fixed to the diaphragm or the holder body of the holder.

The elastic support member 7 include a flexible printed circuit board 71 and an auxiliary diaphragm 73 stacked along a vibrating direction of the diaphragm 31.

Figure 5:
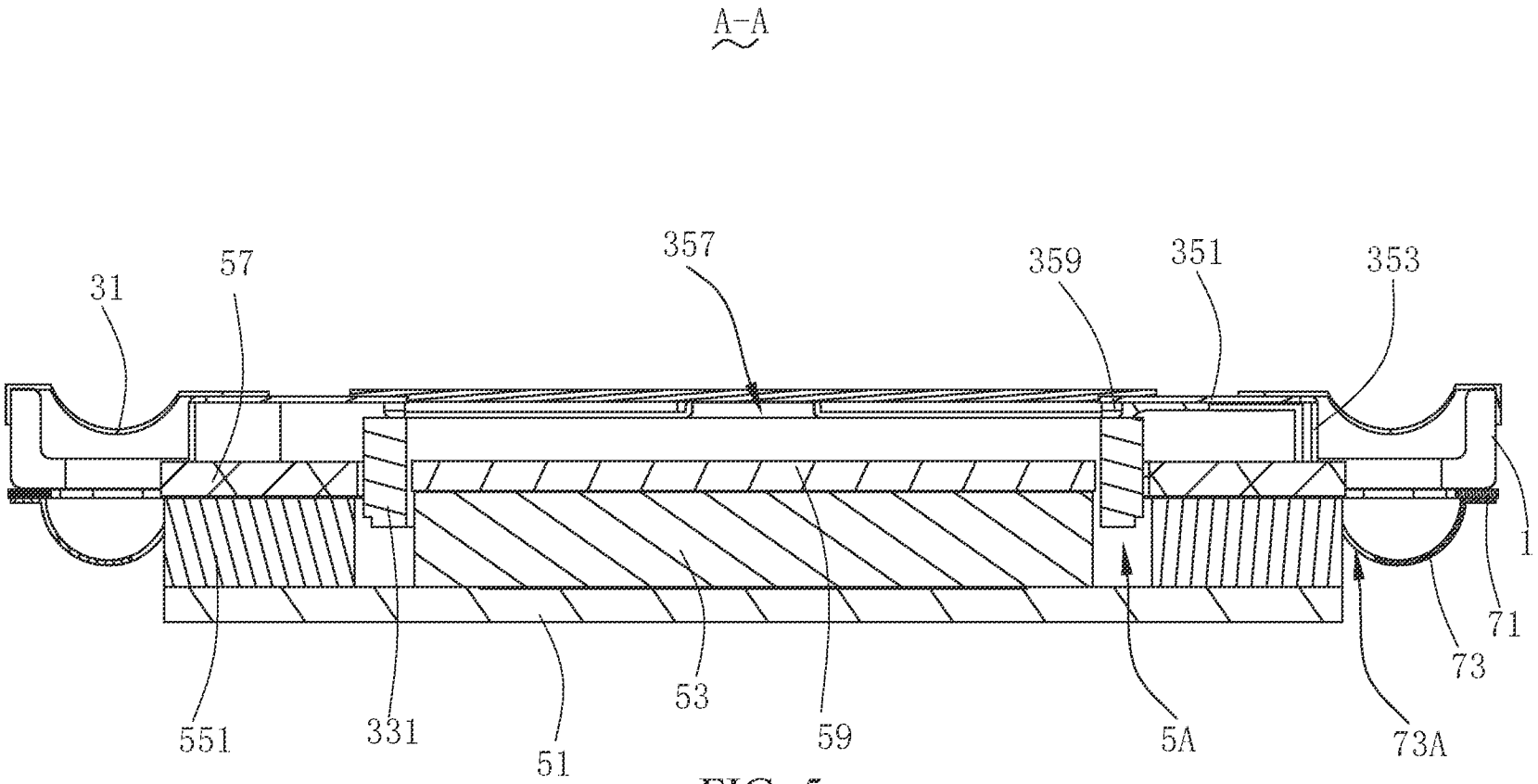
FIG. 5 is a sectional view of the speaker device taken along line A-A shown in FIG. 4.
Figure 6:
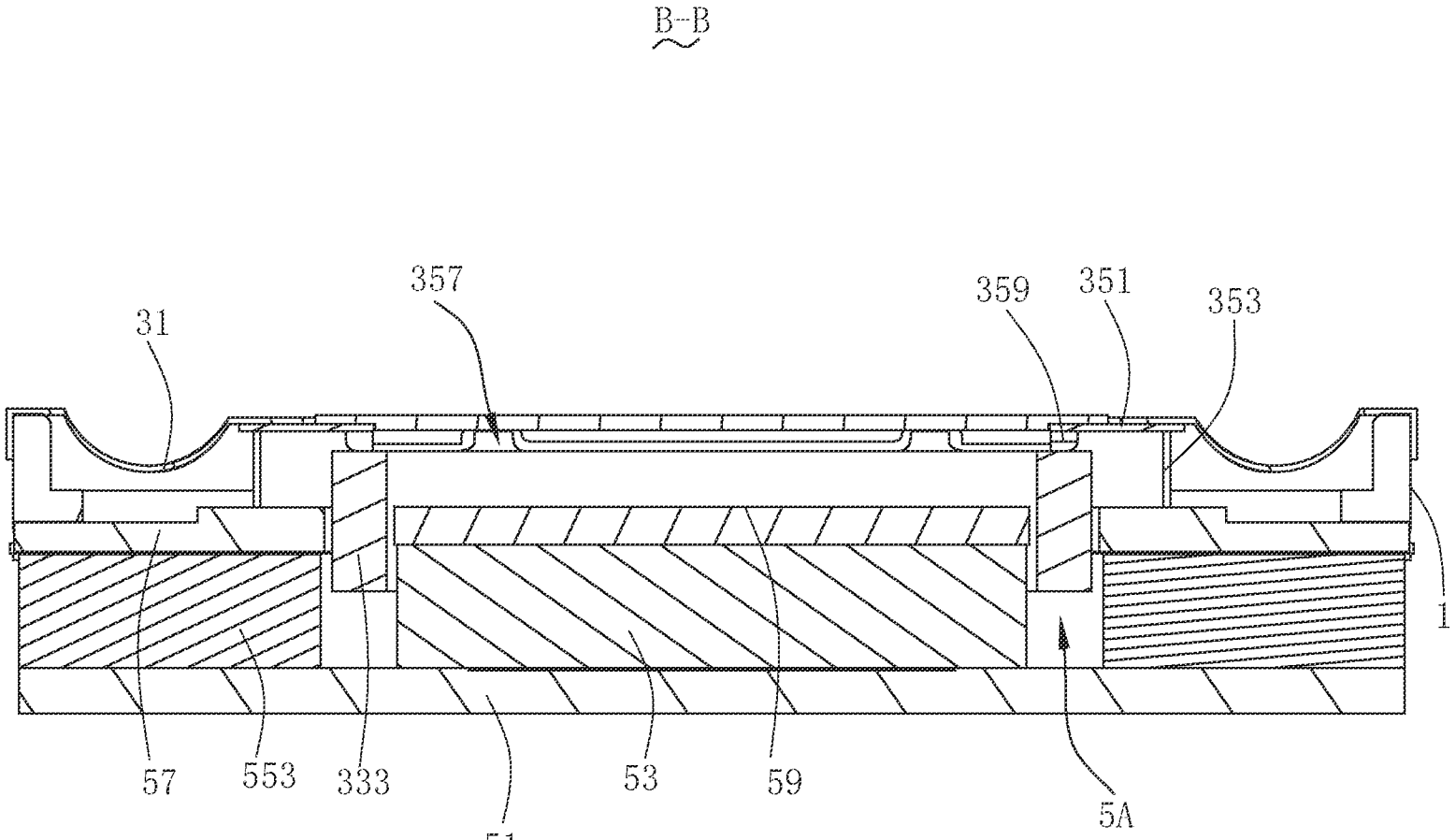
FIG. 6 is a sectional view of the speaker device taken along line B-B shown in FIG. 4.

As shown in FIG. 5, the flexible printed circuit board 71 is located between the auxiliary diaphragm 73 and the diaphragm 31.

The flexible printed circuit board 71 includes a holding portion 711 fixed to the frame 1, a coupling portion 713 fixed to the first connecting portion 353 and an elastic arm 715 connecting the holding portion 711 and the coupling portion 713.

In this embodiment, the flexible printed circuit board 71 further includes a pad portion 717 bending and extending from the coupling portion 713 to the diaphragm 31. The pad portion 717 is provided with a pad electrically connected to a lead wire of the voice coil 33. The flexible printed circuit board 71 functions to support and fix the vibration unit 3. In addition, the holding portion 711 and the pad portion 717 of the flexible printed circuit board 71 are provided with pads (not shown). The elastic arm 715 and the coupling portion 713 are provided therein with a conductive path to electrically connect the pads on the holding portion 711 and the pad portion 717. The pad on the pad portion 717 is connected to the lead wire of the voice coil 33, so as to electrically connect the voice coil 33. The pad on the holding portion 711 is connected to the external circuit, such that the voice coil 33 is electrically connected to the external circuit through the flexible printed circuit board 71. When the speaker device is working, an electrical signal of the external circuit is transmitted to the voice coil 33 through the flexible printed circuit board 71.

It is understandable that, in other implementations, the flexible printed circuit board 71 may not include the pad portion. Correspondingly, the pad electrically connected to the lead wire of the voice coil 33 is provided on the coupling portion.

The auxiliary diaphragm 73 includes a first fixing portion 731 fixed on a side of the holding portion 711 away from the frame 1, a second fixing portion 733 fixed on a side of the coupling portion 713 away from the first connecting portion 353 and a suspension portion 735 connecting the first fixing portion 731 and the second fixing portion 733. An opening of the suspension portion 735 faces the flexible printed circuit board, and orthographic projection of the elastic arm 715 on the auxiliary diaphragm 73 is located within the suspension portion 735. That is, the first fixing portion 731 of the auxiliary diaphragm 73 is fixed to the frame 1 through the holding portion 711, and the second fixing portion 733 of the auxiliary diaphragm 73 is fixed to the first connecting portion 353 through the coupling portion 713.

It is understandable that, in other implementations, the elastic support member may be provided in such a manner that the auxiliary diaphragm is located between the flexible printed circuit board and the diaphragm. Correspondingly, the opening of the suspension portion faces away from the diaphragm. Alternatively, the elastic support members each may only include the auxiliary diaphragm.

The magnetic circuit unit 5 includes a yoke 51, a main magnetic body 53 and an auxiliary magnetic body 55 fixed to the yoke 51, an upper splint 57 covering the auxiliary magnetic body 55 and a pole plate 59 covering the main magnetic body 53. The auxiliary magnetic body 55 encloses the main magnetic body 53 and forms a magnetic gap 5A with the main magnetic body 53. The upper splint 57 is held to the frame 1 so as to hold the magnetic circuit unit 5 to the frame 1. The voice coil 33 is inserted in the magnetic gap 5A, such that when the voice coil 33 is energized, the voice coil 33 vibrates under the action of the magnetic field of the magnetic circuit unit 5. The upper splint 57 is provided with a through hole 571, and the pole plate 59 is located in the through hole 571.

In this embodiment, the upper splint 57 and the pole plate 59 are respectively made of a magnetically conductive material, which enhances a magnetic flux in the magnetic gap 5A.

The auxiliary magnetic body 55 includes first magnetic portions 551 that are respectively spaced apart from the first sides 331 and located in the accommodating spaces 8 and second magnetic portions 553 that are respectively spaced apart from the second sides 333.

The auxiliary diaphragm 73 is provided with an avoiding groove 73A. The first magnetic portions 551 each include a main body portion 555 and an extension portion 557 extending from a side of the main body portion 555 away from the first side 331 into the avoiding groove 73A. The first connecting portions 353 are provided with notches 35A for avoiding extension portions 557.

As shown in FIG. 1, each of the first magnetic portion 551 and the second magnetic portion 553 is provided with two permanent magnets that are spaced from each other. It is understandable that, in other implementations, the first magnetic portion 551 and the second magnetic portion 553 may be formed into one piece, that is, the auxiliary magnetic body 55 may be provided in a continuous ring-shaped structure.

In this embodiment, the main magnetic body 53, the first magnetic portion 551 and the second magnetic portion 553 are magnets. Certainly, as another implementation of the main magnetic body 53, the first magnetic portion 551 and the second magnetic portion 553, the main magnetic body 53 may also include two main magnets. The two main magnets are stacked along the vibrating direction of the diaphragm 31, and polarities of the two main magnets are opposite. Correspondingly, the first magnetic portion 551 and the second magnetic portion 553 may respectively include two auxiliary magnets. The two auxiliary magnets are stacked along the vibrating direction of the diaphragm 31, and polarities of the two auxiliary magnets are opposite. Alternatively, a magnetic conductor made of a magnetically conductive material may be sandwiched between the two main magnets and the two auxiliary magnets.

Of course, in other implementations, the magnetic circuit unit 5 may not include the pole plate or the upper splint. Correspondingly, the second magnetic portions are fixed to the frame so as to fix the magnetic circuit unit to the frame.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker device, comprising a frame and a vibration unit and a magnetic circuit unit respectively held to the frame, wherein the vibration unit comprises a diaphragm held to the frame, a voice coil driving the diaphragm to vibrate and produce sound, and a holder; the holder comprises a holder body fixed to the diaphragm and a first connecting portion extending from the holder body in a direction away from the diaphragm; the voice coil comprises a pair of first sides and a pair of second sides connected between the first sides; each of the pair of the first sides is provided with an elastic support member; one end of the elastic support member is fixed to the frame, and another end of the elastic support member is fixed to the first connecting portion; each of the pair of the elastic support members and each of the pair of the first sides enclose an accommodating space;

the magnetic circuit unit comprises a main magnetic body and an auxiliary magnetic body surrounding the main magnetic body, and a magnetic gap is formed between the auxiliary magnetic body and the main magnetic body; the auxiliary magnetic body comprises a first magnetic portion that is spaced apart from the first sides and located in the accommodating space and a second magnetic portion that is spaced apart from the second sides; wherein each of the pair of the elastic support members comprises an auxiliary diaphragm; the auxiliary diaphragm is provided with an avoiding groove; the auxiliary diaphragm comprises a first fixing portion fixed to the frame, a second fixing portion connected to the first connecting portion, and a suspension portion connecting the first fixing portion and the second fixing portion; and the avoiding groove extends, from a side of the second fixing portion away from the first fixing portion, to the suspension portion, the first magnetic portion comprises a main body portion disposed between the second fixing portion and the first sides, and an extension portion extending, from a side of the main body portion away from the first sides, into the avoiding groove; and the first connecting portion is provided with a notch for avoiding the extension portion.

2. The speaker device as described in claim 1, wherein the first magnetic portion and the second magnetic portion are formed into one piece.

3. The speaker device as described in claim 1, wherein each of the first magnetic portion and the second magnetic portion is provided with two permanent magnets that are spaced from each other.

4. The speaker device as described in claim 1, wherein the elastic support member further comprise a flexible printed circuit board; the flexible printed circuit board comprises a holding portion connected to the first fixing portion, a coupling portion connected to the second fixing portion, and an elastic arm connecting the holding portion and the coupling portion; the suspension portion has an opening facing the flexible printed circuit board, and an orthographic projection of the elastic arm on the auxiliary diaphragm is located within the suspension portion.

5. The speaker device as described in claim 4, wherein the flexible printed circuit board is located between the auxiliary diaphragm and the diaphragm.

6. The speaker device as described in claim 1, wherein the holder further comprises a second connecting portion extending from the holder body in the direction away from the diaphragm; and the voice coil is connected to the second connecting portion.

7. The speaker device as described in claim 6, wherein the second connecting portion is provided with a plurality of gaps; the plurality of gaps divides the second connecting portion into a plurality of isolation portions that is spaced apart from each other; and the voice coil is fixed to the plurality of isolation portions.

8. The speaker device as described in claim 1, wherein the magnetic circuit unit further comprises an upper splint covering the auxiliary magnetic body and fixed to the frame, and a pole plate covering the main magnetic body; and the upper splint is provided with a through hole, and the pole plate is located in the through hole.

* * * * *